US009744590B2

(12) United States Patent
Schroeder et al.

(10) Patent No.: US 9,744,590 B2
(45) Date of Patent: Aug. 29, 2017

(54) APPARATUS FOR INJECTING MOLTEN METAL INTO A DIE CAST MACHINE AND METHODS AND CONTROL SYSTEMS FOR COOLING THE SAME

(71) Applicant: Honda Motor Co., Ltd., Minato-ku, Tokyo (JP)

(72) Inventors: Karl Schroeder, Columbus Grove, OH (US); Robert C. De Neff, Bellefontaine, OH (US); Tom Stasiak, Troy, OH (US); Tim Hider, Minster, OH (US); Shane Homan, New Bremen, OH (US); Don Whitmore, Wapakoneta, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/273,268

(22) Filed: May 8, 2014

(65) Prior Publication Data

US 2015/0321248 A1 Nov. 12, 2015

(51) Int. Cl.

| | |
|---|---|
| ***B22D 17/26*** | (2006.01) |
| ***B22D 17/32*** | (2006.01) |
| ***B22D 17/20*** | (2006.01) |
| ***B22D 39/02*** | (2006.01) |

(52) U.S. Cl.

CPC ..... *B22D 17/263* (2013.01); *B22D 17/203* (2013.01); *B22D 17/2038* (2013.01); *B22D 17/32* (2013.01); *B22D 39/026* (2013.01)

(58) Field of Classification Search

CPC .... B22D 17/00; B22D 17/20; B22D 17/2015; B22D 17/203; B22D 17/2038; B22D 15/00; B22D 15/04

See application file for complete search history.

(56) References Cited

U.S. PATENT DOCUMENTS

| | | | | |
|---|---|---|---|---|
| 4,086,953 | A * | 5/1978 | Kraklau | B22D 17/2023 164/312 |
| 4,311,185 | A | 1/1982 | Zimmerman | |
| 4,334,575 | A | 6/1982 | Miki et al. | |
| 4,651,683 | A | 3/1987 | Nishida | |
| 5,425,411 | A | 6/1995 | Kami | |
| 6,030,442 | A | 2/2000 | Kabra et al. | |
| 6,375,901 | B1 | 4/2002 | Robotti et al. | |

(Continued)

*Primary Examiner* — Kevin P Kerns
*Assistant Examiner* — Steven Ha
(74) *Attorney, Agent, or Firm* — Arent Fox LLP

(57) ABSTRACT

An apparatus for injecting molten metal into a die cast machine is provided. The apparatus includes a molten metal reservoir having a first open end in fluid communication with a die casting mold and a second open end. The molten metal reservoir includes at least one first cooling fluid path positioned about at least a portion of an outer surface of the molten metal reservoir and in thermal contact with the molten metal reservoir. The apparatus further includes a plunger sized to fit within the second open end. The plunger includes a plunger tip and a second cooling fluid path defined within the plunger tip and in thermal contact with the molten metal reservoir. A plurality of thermal actuators are also provided. Each of the plurality of thermal actuators controls a volume of cooling fluid flowing through one first cooling fluid path of the at least one first cooling fluid path or the second cooling fluid path.

17 Claims, 4 Drawing Sheets

(56) References Cited

U.S. PATENT DOCUMENTS

| | | | | |
|---|---|---|---|---|
| 6,409,147 | B1 | 6/2002 | Kenny et al. | |
| 6,443,216 | B1 | 9/2002 | Lombard et al. | |
| 6,685,442 | B2 | 2/2004 | Chinn et al. | |
| 6,698,496 | B2 | 3/2004 | Takayama et al. | |
| 6,722,632 | B2 | 4/2004 | Kenny et al. | |
| 6,796,362 | B2 | 9/2004 | Lombard et al. | |
| 7,273,096 | B2 | 9/2007 | Den Boer et al. | |
| 7,600,378 | B2 | 10/2009 | Yeghiazarian et al. | |
| 8,356,655 | B2 | 1/2013 | Bochiechio et al. | |
| 2006/0042771 | A1* | 3/2006 | Ward | B22C 9/065 164/122 |
| 2013/0186525 | A1* | 7/2013 | Koch | B22C 9/06 148/549 |
| 2013/0192833 | A1* | 8/2013 | Gano | F16K 31/002 166/302 |

* cited by examiner

APPARATUS FOR INJECTING MOLTEN METAL INTO A DIE CAST MACHINE AND METHODS AND CONTROL SYSTEMS FOR COOLING THE SAME

BACKGROUND

The subject matter disclosed herein relates to die casting and, more particularly, to an apparatus for injecting molten metal into a die cast machine and methods and control systems for cooling the apparatus.

Die cast machines are used to manufacture high volume parts from molten metal in an efficient and repeatable process. As with any process that involves molten metal, controlling the operational parameters on aspects of the process may have significant impacts on machine throughput, the quality of the parts manufactured, and the amount of downtime for a die cast machine.

Many die cast machines include an apparatus for injecting molten metal into a cavity to form a part. How the apparatus functions may be an important part of the die cast process. Temperature control of the apparatus before, during, and after the molten metal is supplied to the apparatus may be one parameter that may be controlled to improve the process of a die cast machine. Inadequate or improper cooling of an apparatus may result in part defects and/or inefficient operation of a die cast machine.

An apparatus for injecting molten metal into a cavity within a die cast machine that controls the temperature of the molten metal while optimizing the throughput of a die cast machine and die cast process is desirable.

SUMMARY

According to one aspect, an apparatus for injecting molten metal into a die cast machine includes a molten metal reservoir having a first open end in fluid communication with a die casting mold and a second open end. The molten metal reservoir includes at least one first cooling fluid path positioned about at least a portion of an outer surface of the molten metal reservoir and in thermal contact with the molten metal reservoir. The apparatus further includes a plunger sized to fit within the second open end. The plunger includes a plunger tip and a second cooling fluid path defined within the plunger tip and in thermal contact with the molten metal reservoir. Each of a plurality of thermal actuators controls a volume of cooling fluid flowing through one first cooling fluid path of the at least one first cooling fluid path or the second cooling fluid path.

According to a further aspect, a method for cooling an apparatus for injecting molten metal into a die cast machine is provided. The apparatus includes a molten metal reservoir having a first open end in fluid communication with a die casting mold and a second open end. The molten metal reservoir includes at least one first cooling fluid path positioned about at least a portion of an outer surface of the molten metal reservoir and in thermal contact with the molten metal reservoir. A plunger is sized to fit within the second open end. The plunger includes a plunger tip and a second cooling fluid path defined within the plunger tip and in thermal contact with the molten metal reservoir. The at least one first cooling fluid path and the second cooling fluid path is in fluid communication with at least one thermal actuator. The method includes receiving by the at least one thermal actuator a flow of cooling fluid from an outlet of one first cooling fluid path of the at least one first cooling fluid path or the second cooling fluid path. The flow of cooling fluid is controlled by the at least one thermal actuator controlling the flow of cooling fluid flowing through the at least one first cooling fluid path and the second cooling fluid path by increasing or decreasing a volume of cooling fluid flowing through the corresponding thermal actuator.

According to another aspect, a system for controlling a flow of cooling fluid through an apparatus for injecting molten metal into a die cast machine is provided. The apparatus includes a molten metal reservoir having a first open end in fluid communication with a die casting mold and a second open end. The molten metal reservoir includes at least one first cooling fluid path positioned about at least a portion of an outer surface of the molten metal reservoir and in thermal contact with the molten metal reservoir. A plunger is sized to fit within the second open end. The plunger includes a plunger tip and a second cooling fluid path defined within the plunger tip and in thermal contact with the molten metal reservoir. The system includes at least one thermal actuator. The at least one thermal actuator controls the flow of cooling fluid flowing through one of the at least one first cooling fluid path and the second cooling fluid path.

BRIEF DESCRIPTION OF THE DRAWINGS

Other aspects and advantages of certain embodiments will become apparent upon consideration of the following detailed description, wherein similar structures have similar reference numerals.

DETAILED DESCRIPTION

Figure 1:
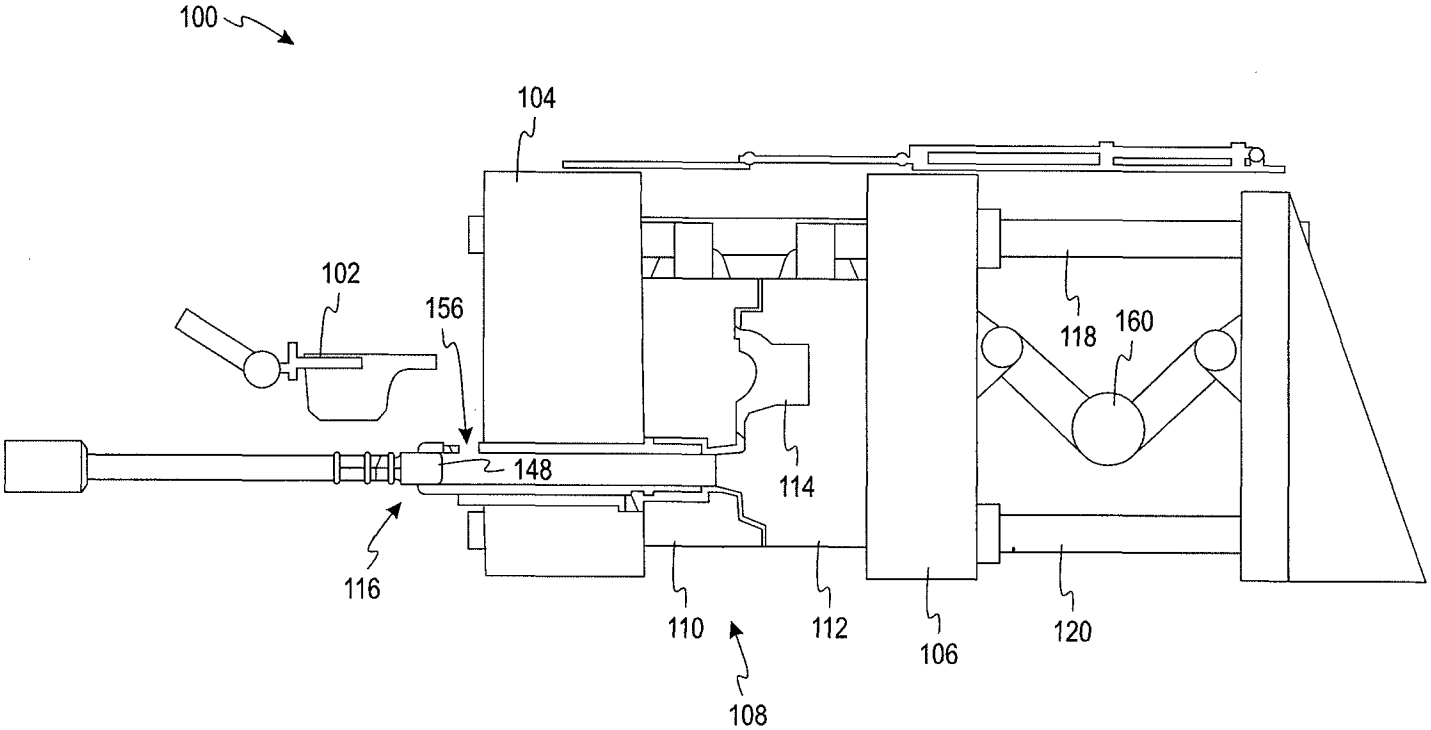
FIG. 1 is a partial sectional view of an exemplary die cast machine including an apparatus for injecting molten metal into the die cast machine.

Referring initially to FIG. 1, a partial sectional view of a die cast machine 100 and a source of molten metal 102 are depicted. The die cast machine 100 includes a stationary platen 104 and a moving platen 106. The die cast machine also includes a mold 108 positioned between the stationary platen 104 and the moving platen 106. The mold 108 includes a fixed die 110 and a moving die 112. The fixed die 110 is attached to the stationary platen 104 and the moving die 112 is attached to the moving platen 106. The fixed die 110 and the moving die 112 are configured to define a mold cavity 114. The die cast machine 100 further includes an apparatus 116 in fluid communication with the mold cavity 114. An upper guide rail 118 and a lower guide rail 120 are configured to pass through the moving platen 106 and the stationary platen 104. The moving platen 106 and the moving die 112 are configured to slide on the guide rails 118, 120 to permit opening of the mold 108 for extracting a part from the mold cavity 114.

Figure 2:
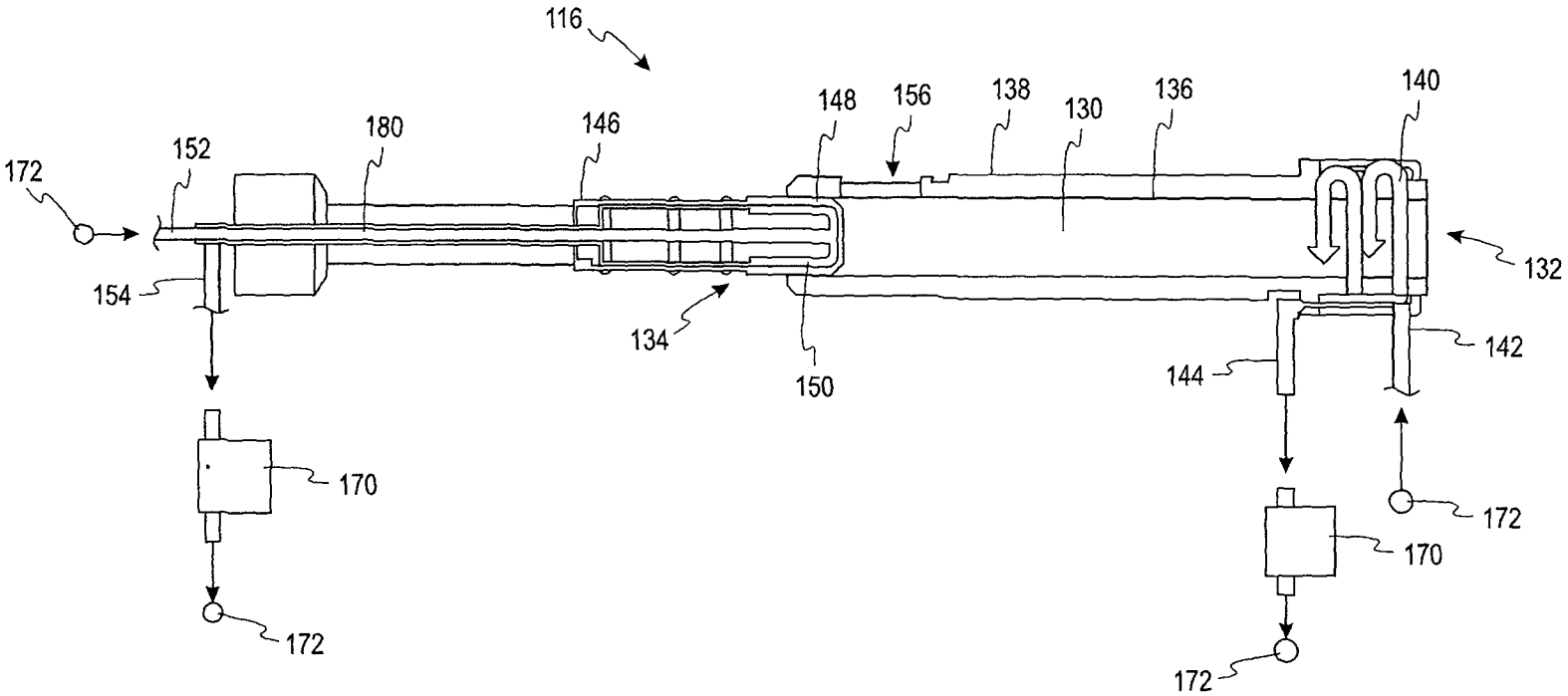
FIG. 2 is a sectional view of the apparatus shown in FIG. 1.

Referring to FIG. 2, an exemplary embodiment of the apparatus 116 is depicted. The apparatus 116 is configured to inject molten metal under high pressure into the mold cavity 114 of the die cast machine 100. The apparatus 116 includes a generally cylindrical reservoir 130 that includes a first open end 132 and a second open end 134. An outer surface 136 of the reservoir 130 is surrounded by a water jacket 138. The water jacket 138 includes at least one first cooling fluid path 140 in thermal communication with the reservoir 130.

The first cooling path 140 includes a cooling fluid inlet 142 and a cooling fluid outlet 144. The second open end 134 is sized to receive a plunger 146. The plunger 146 includes a first end or tip 148. Defined within the plunger tip 148 is a second cooling fluid path 150 in thermal communication with the reservoir 130. The second cooling fluid path also includes a cooling fluid inlet 152 and a cooling fluid outlet 154. An aperture 156 defined by the outer surface 136 of the reservoir 130 provides for fluid communication between the source of molten metal 102 and the reservoir 130.

Referring now to FIGS. 1 and 2, in one embodiment, molten metal is poured from the source of molten metal 102 through the aperture 156 into the reservoir 130. The plunger 146 is driven into the reservoir 130 by drive means (not shown). The drive means may include any suitable drive mechanism understood by one having skill in the art (e.g., hydraulic, pneumatic, gear driven, and/or electrical drive means). The movement of the plunger 146 into the reservoir 130 injects the molten metal in the reservoir 130 out of the first open end 132 and into the mold 108, specifically the mold cavity 114. The die cast machine 100 then waits as the molten metal cools and solidifies into a solid piece. The wait time is understood by one having skill in the art to depend on the size and complexity of the part being manufactured along with the various process parameters. After sufficient cooling has occurred, an opening mechanism 160 releases the pressure holding the moving die 112 and the moving platen 106 and pulls the mold 108 open to permit removal of the part within. Next, the opening mechanism 160 closes the mold 108 and applies a significant force to prevent molten metal from escaping for the next part. The plunger 146 is extracted by the drive means (not shown) and the die cast machine 100 is ready for the next shot. It is contemplated that the configuration and sequence of operation may be different as understood by one having skill in the art. The specific process parameters may vary significantly (e.g., mold closing force, temperature and volume of molten metal) as the size of the die cast machine 100 and part produced changes.

Still referring to FIG. 2, during the operational sequence of the die cast machine 100, different components of the apparatus 116 undergo different temperature variations. Controlling the temperature of the molten metal and the various components of the apparatus 116 may be one way to reduce defects in the product produced and/or maintain the operational efficiency of the die cast machine 100 at a high level. Controlling the temperature experienced by the reservoir 130, the plunger tip 148, and/or the molten metal within the reservoir 130 may be accomplished by controlling the flow of cooling fluid through the at least one first cooling fluid path 140 and the second cooling fluid path 150. In the exemplary embodiment depicted in FIG. 2, this may be accomplished by thermal actuators 170 in fluid communication with the cooling fluid outlets 144, 154 of the first cooling fluid path 140 and the second cooling fluid path 150. The first cooling fluid path 140 is depicted schematically to be in thermal contact with the outer surface 136 of the reservoir 130 by encircling the reservoir 130. The first cooling fluid path 140 may be configured to receive cooling fluid from a cooling fluid source 172 into the inlet 142. The cooling fluid passes through the first cooling fluid path 140 within the water jacket 138 and absorbs heat through the outer surface 136 of the reservoir 130 and passes out through the outlet 144. The heated cooling fluid then passes into a thermal actuator 170 before flowing back to the hot cooling fluid return of the cooling fluid source 172.

In the embodiment depicted in FIG. 2, the first cooling fluid path 140 is configured to cool the outer surface 136 of the reservoir 130 proximate the second open end 132. It is contemplated that the first cooling fluid path 140 may cool an entire length of the outer surface 136 in another embodiment. Alternatively, in one embodiment, the first cooling path 140 includes multiple zones along the length of the reservoir 130. Each zone independently flows cooling fluid from the source of cooling fluid 172 about a corresponding portion of the outer surface 136 to absorb heat and then out through independent thermal actuators 170 before returning to the source of cooling fluid 172. It is understood that the physical path the first cooling fluid path 140 may be configured differently to optimize the heat transfer from the outer surface 136 of the reservoir 130 to the cooling fluid within the first cooling fluid path 140.

Still referring to FIG. 2, in the embodiment depicted, the second cooling fluid path 150 is configured to receive cooling fluid from the cooling fluid source 172 through the inlet 152. The cooling fluid flows into the plunger 146 and travels along a pipe 180 until reaching the second cooling fluid path 150 within the plunger tip 148. The cooling fluid absorbs heat through the plunger tip 148 from the reservoir 130 before traveling back out of the plunger 146 through the outlet 154. The cooling fluid then passes through an independent thermal actuator 170 before returning to the source of cooling fluid 172. As depicted in FIG. 2, the outlet 154 is configured with the pipe 180 passing through the outlet 154 along the length of the plunger 146. It is understood that many different configurations of the second cooling fluid path 150 from the inlet 152 to the plunger tip 148 and to the outlet 154 are possible and understood by one having skill in the art.

It is also contemplated that the cooling fluid source 172 as described previously may take several different embodiments. For example, each independent thermal actuator 170 may be proximate to one of the cooling fluid outlets 144, 154. Further an independent cooling fluid chilling unit (not shown) may be proximate to each independent thermal actuator 170. In another embodiment, the cooling fluid flows from the independent thermal actuators 170 to a single cooling fluid chilling unit (not shown). In a further alternative embodiment, the cooling fluid source 172 includes a large cooling fluid system that receives heated cooling fluid from a plurality of thermal actuators 170 receiving hot cooling fluid from the plungers 146 and the reservoirs 130 of different die cast machines 100. One having skill in the art would understand the many different configurations of the cooling fluid sources 172 that may be employed to work with the apparatus 116 as disclosed in the embodiments of the present application.

Figure 3:
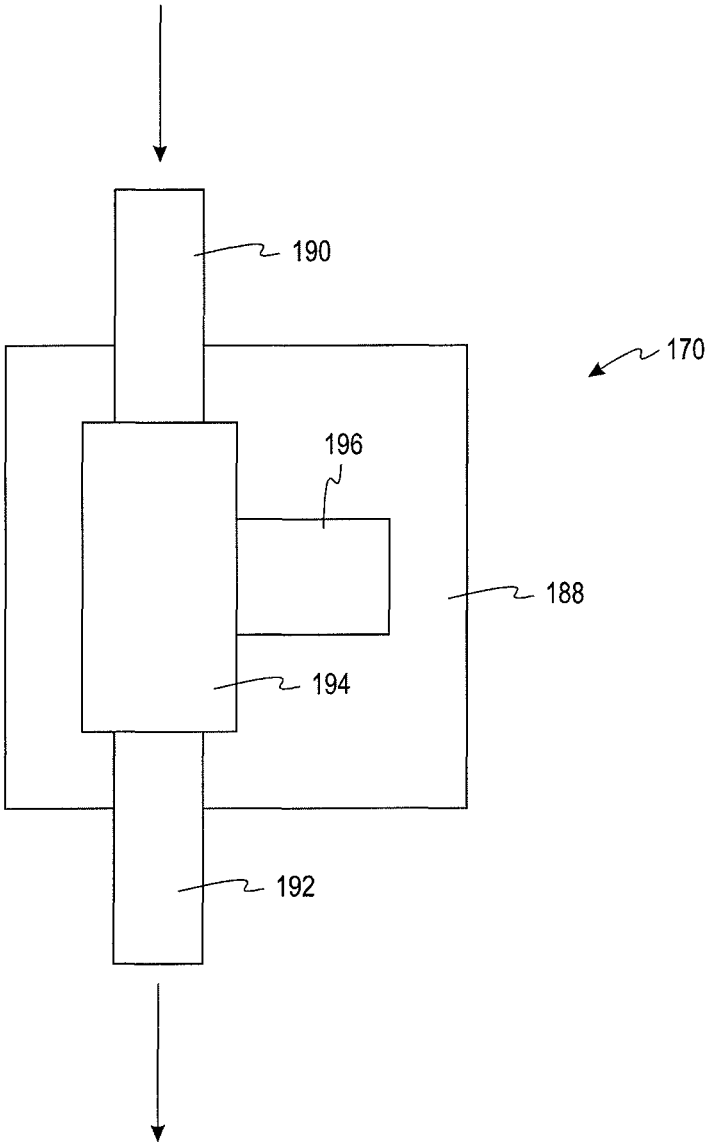
FIG. 3 is a schematic representation of an exemplary thermal actuator.

Referring now to FIG. 3, a schematic view of a thermal actuator 170 is depicted. The thermal actuator 170 includes a housing 188, a cooling fluid inlet 190 and a cooling fluid outlet 192. Disposed between the cooling fluid inlet 190 and the cooling fluid outlet 192 is a variable flow passage 194. A phase change material 196 is in thermal communication with the cooling fluid flowing through the variable flow passage 194. In this embodiment, the phase change material 196 is configured to change or adjust the amount of cooling fluid flowing through the variable flow passage 194 as a temperature of the cooling fluid changes. In one embodiment, the cooling fluid inlet 190 is in fluid communication with one of the cooling fluid outlets 144, 154 of the first cooling path 140 or the second cooling fluid path 150. When no molten metal is present in the reservoir 130 and the die cast machine 100 has not been used (for example, during a changing of the mold 108 or machine maintenance) very little or no thermal transfer takes place between the reservoir 130 and the cooling fluid paths 140, 150. The phase change material 196 may be in a first solid phase and the variable flow passage 194 may be configured to allow a minimum flow of cooling fluid to pass through. When molten metal is introduced to the reservoir 130, significant thermal transfer will take place with the cooling fluid flowing through the cooling paths 140, 150. As heated cooling fluid flows into the thermal actuators 170, the phase change material 196 may begin to change to a second liquid phase and expand significantly in volume. The expansion of the phase change material 196 may trigger mechanical means (not shown) to increase the flow of cooling fluid through the corresponding cooling fluid path 140, 150. As the die cast machine 100 cycles through the production process, the independent thermal actuators 170 control a volume of cooling fluid flowing through the corresponding cooling fluid paths 140, 150. The volume of the cooling fluid flow is dependent on the temperature of the cooling fluid and the characteristics of the thermal actuators 170. In one embodiment, it is contemplated that as the cooling fluid temperature increases, the flows of cooling fluid through the thermal actuators 170 and corresponding cooling fluid paths 140, 150 of the apparatus 116 will increase. Further, as the temperature of the cooling fluid decreases the flows of the cooling fluid through the thermal actuators 170 and corresponding cooling fluid paths 140, 150 will decrease.

Figure 4:
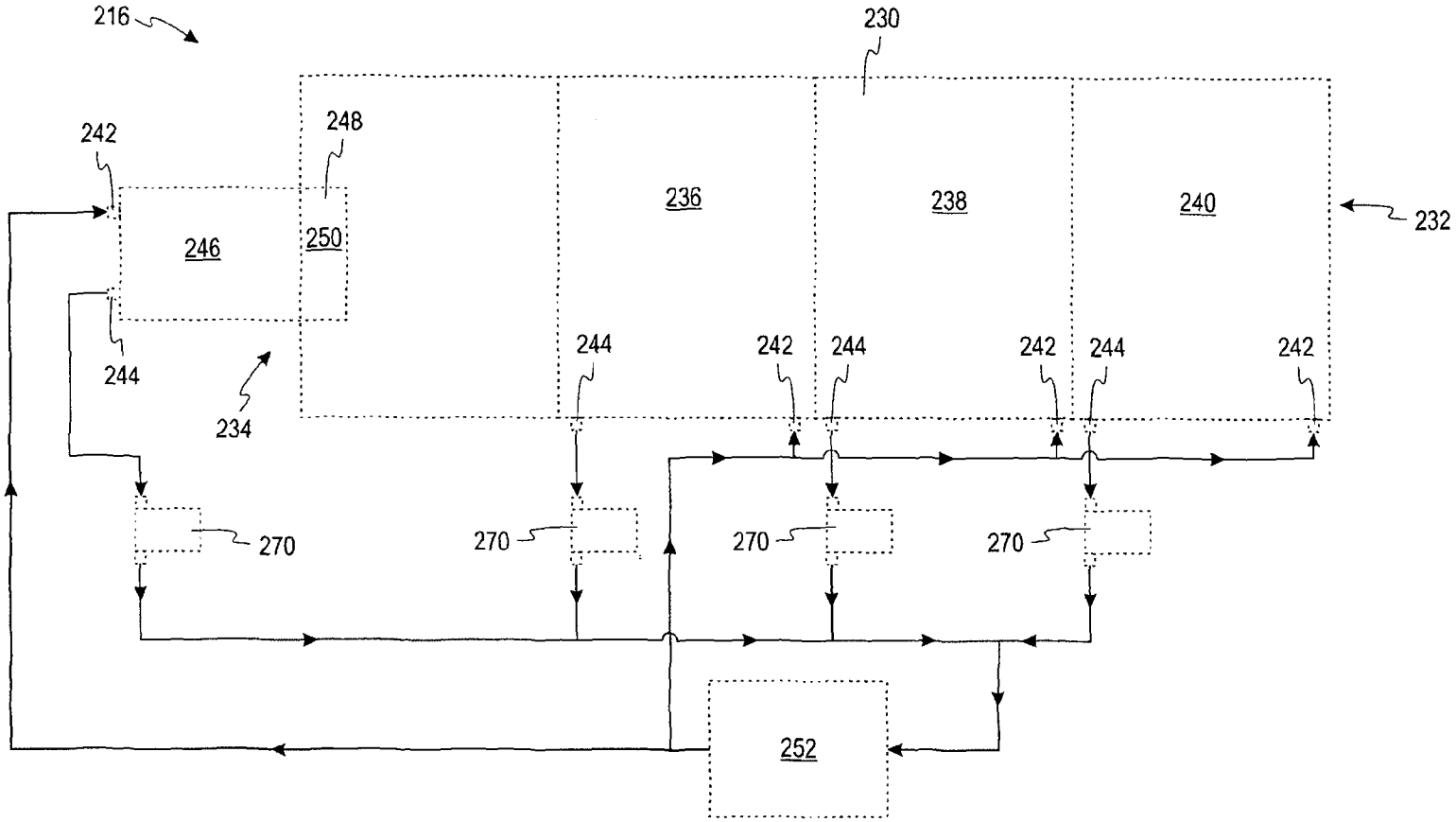
FIG. 4 is a schematic representation of another exemplary embodiment of the apparatus shown in FIG. 2.

Referring now to FIG. 4, a schematic view of an alternate embodiment of an apparatus 216 for injecting molten metal into the die cast machine 100 is depicted. The apparatus 216 may include identical elements to the apparatus 116. The apparatus 216 includes a reservoir 230 that includes a first open end 232 and a second open end 234. The reservoir 230 defines a first-first cooling fluid path 236, a second-first cooling fluid path 238, and a third-first cooling fluid path 240. Each of the first cooling fluid paths 236, 238, 240 is in thermal contact with the reservoir 230 and includes a cooling fluid inlet 242 and an outlet 244. A plunger 246 is sized to be received by the second open end 234 of the reservoir 230. The plunger 246 includes a plunger tip 248. The plunger tip 248 defines a second cooling fluid path 250 in thermal communication with the reservoir 230 and fluid communication with an inlet 242 and an outlet 244. Each of the cooling fluid inlets 242 is in fluid communication with a cooling fluid source 252. Each of the cooling fluid outlets 244 is in fluid communication with one of a plurality of thermal actuators 270, which have the same characteristics of the thermal actuator 170 depicted in FIG. 3 and described above. Each thermal actuator 270 is in fluid communication with the cooling fluid source 252 to allow the heated cooling fluid to return to the cooling fluid source 252 to be cooled. The cooling fluid cycle of the apparatus 216 is similar to the cooling fluid cycle of the apparatus 116 except the first-first cooling fluid path 236, the second-first cooling fluid path 238, and the third-first cooling fluid path 240 have independent cooling flows controlled by corresponding independent thermal actuators 270. The thermal actuators 270 adjust the flow of cooling fluid flowing through the corresponding cooling fluid paths 236, 238, 240, 250 in response to changes in temperature of the cooling fluid during the operational cycle of the die cast machine 100.

It is contemplated that individual thermal actuators 270 may have different properties in embodiments with more than one cooling fluid path that include a plurality thermal actuators 270. The management of the thermal load of each cooling fluid path may be customized by modifying the properties of the corresponding thermal actuator 270 coupled to a specific cooling fluid path 236, 238, 240, 250. In one embodiment, the temperature at which the phase change material 196 transitions from a solid to a liquid may be different between independent thermal actuators 270. In another embodiment, the minimum flow of cooling fluid and the maximum flow of cooling fluid may be more or less before and after the phase change material changes phase to optimize the management of the thermal load of one or more cooling fluid paths 236, 238, 240, 250 by one or more independent thermal actuators 270. In yet another embodiment, the difference between the maximum flow of cooling fluid and the minimum flow of cooling fluid may be different between thermal actuators 270. In these and other embodiments, the properties of an independent thermal actuator 270 can be adjusted to compensate for different thermal loads of different cooling paths 236, 238, 240, 250 to provide an optimized system.

Some advantages of the embodiment depicted in FIG. 4 are that the independent flows of cooling fluid through the first cooling fluid paths 236, 238, 240 and the second cooling fluid path 250 controlled by the independent thermal actuators 270 allow for different heat loads of the different cooling fluid paths 236, 238, 240, 250. For example, the second cooling fluid path 250 within the plunger tip 248 is in contact with the molten metal for the entire injection process. In contrast, the first-first cooling fluid path 236 is only in thermal contact with molten metal within the reservoir 230 until the plunger tip 248 pushes the molten metal past the first-first cooling fluid path 236. Thus, the cooling requirements are different and require different flows of cooling fluid. Also, no electronic sensors or monitoring is required to ensure that the correct amount of cooling fluid is flowing through the cooling fluid paths 236, 238, 240, 250. The thermal actuators 270 are completely self contained. The embodiments depicted share the advantage of having automatic flow control of the cooling fluid without complex monitoring systems. Thus, the apparatus 116, 216 are not over cooled or under cooled. Each condition is undesirable and may result in defects in the product and/or reduced efficiency of the die cast machine 100.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather, it is hereby intended the scope be defined by the claims appended hereto. Additionally, the features of various implementing embodiments may be combined to form further embodiments.

What is claimed is:

1. An apparatus for injecting molten metal into a die cast machine, the apparatus comprising:

a molten metal reservoir having a first open end in fluid communication with a die casting mold and a second open end, the molten metal reservoir including a plurality of independent and adjacent first cooling fluid paths arranged along a length of the molten metal reservoir between the first open end and the second open end, each first cooling fluid path encircling a portion of the length of the molten metal reservoir, and being in thermal contact with the molten metal reservoir;

a plunger sized to fit within the second open end, the plunger including a plunger tip and a second cooling fluid path defined within the plunger tip and in thermal contact with the molten metal reservoir; and a plurality of thermal actuators, each of the plurality of thermal actuators independently controlling a volume of cooling fluid flowing through a respective one of the plurality of independent and adjacent first cooling fluid paths and the second cooling fluid path.

2. The apparatus of claim 1, wherein each of the plurality of independent and adjacent first cooling fluid paths and the second cooling fluid path includes an inlet and an outlet and each thermal actuator receiving cooling fluid from the outlet of the respective first cooling fluid path of the plurality of independent and adjacent first cooling fluid paths or the second cooling path.

3. The apparatus of claim 2, wherein each thermal actuator is configured to adjust the cooling fluid flowing in the respective one of the plurality of independent and adjacent first cooling fluid paths and the second cooling path in response to a change in temperature of the cooling fluid.

4. The apparatus of claim 3, wherein each thermal actuator is configured to increase a flow of cooling fluid in response to an increase in temperature of the cooling fluid.

5. The apparatus of the claim 4, wherein each thermal actuator is configured to decrease a flow of cooling fluid in response to a decrease in temperature of the cooling fluid.

6. The apparatus of claim 5, wherein each thermal actuator includes a phase change material in thermal contact with the cooling fluid, the phase change material controlling a response of the thermal actuator to increase or decrease the flow of cooling fluid.

7. The apparatus of claim 6, wherein the inlet of each of the plurality of independent and adjacent first cooling fluid paths and the second cooling fluid path is coupled to a cooling fluid source, and each thermal actuator includes an outlet in fluid communication with the cooling fluid source to return cooling fluid to the cooling fluid source.

8. The apparatus of claim 7, wherein the outer surface of the molten metal reservoir defines an aperture providing fluid communication between a source of molten metal and an interior of the molten metal reservoir for introducing molten metal into the molten metal reservoir.

9. The apparatus of claim 1, wherein each of the plurality of thermal actuators independently controls the volume of cooling fluid flowing through each one of the plurality of independent and adjacent first cooling fluid paths and the second cooling fluid path in response to the temperature of a cooling fluid flowing through each respective thermal actuator.

10. The apparatus of claim 1, wherein each of the plurality of thermal actuators independently controls the volume of cooling fluid flowing through each one of the plurality of independent and adjacent first cooling fluid paths and the second cooling fluid path to enable independent temperature control of different portions of the length of the molten metal reservoir.

11. A system for controlling a flow of cooling fluid through an apparatus for injecting molten metal into a die cast machine, the apparatus including a molten metal reservoir having a first open end in fluid communication with a die casting mold and a second open end, a plunger sized to fit within the second open end, the plunger including a plunger tip, and a plurality of independent and adjacent first cooling fluid paths, and a second cooling fluid path defined within the plunger tip and in thermal contact with the molten metal reservoir, the system comprising:

each of a plurality of thermal actuators independently controlling a flow of cooling fluid through a respective one of the plurality of independent and adjacent first cooling fluid paths and the second cooling fluid path, wherein each of the plurality of independent and adjacent first cooling fluid paths is arranged along a length of the molten metal reservoir between the first open end and the second open end and each first cooling fluid path encircles a portion of the length of the molten metal reservoir, and is in thermal contact with the molten metal reservoir.

12. The system of claim 11, wherein each thermal actuator is in fluid communication with an outlet of the respective one of the the plurality of independent and adjacent first cooling fluid paths and the second cooling fluid path.

13. The system of claim 12, wherein each thermal actuator includes a phase change material in thermal contact with the flow of cooling fluid through the respective thermal actuator, and the phase change material controlling a response of each thermal actuator to increase or decrease the flow of cooling fluid.

14. The system of claim 13, wherein each of the plurality of independent and adjacent first cooling fluid paths and the second cooling fluid path includes an inlet in fluid communication with a cooling fluid source, and each thermal actuator includes an outlet in fluid communication with a fluid return of the cooling fluid source.

15. The system of claim 14, wherein an increase in temperature of the cooling fluid flowing through one of the plurality of independent and adjacent first cooling fluid paths or the second cooling fluid path causes a response in each thermal actuator to increase the flow of cooling fluid through each thermal actuator.

16. The system of claim 15, wherein a decrease in temperature of the cooling fluid flowing through one of the plurality of independent and adjacent first cooling fluid paths or the second cooling fluid path causes a response in each thermal actuator to decrease the flow of cooling fluid through each thermal actuator.

17. The system of claim 16, wherein the apparatus further includes an aperture defined through the molten metal reservoir providing fluid communication between a source of molten metal and an interior of the molten metal reservoir for introducing molten metal into the molten metal reservoir, and the temperature of the flow of cooling fluid through one of the plurality of independent and adjacent first cooling fluid paths or the second cooling fluid path increases in response to the temperature and a duration of the molten metal within the molten metal reservoir and decreases after the plunger pushes the molten metal into the die casting mold.

* * * * *